US012130019B2

(12) United States Patent
Abdelhalim et al.

(10) Patent No.: US 12,130,019 B2
(45) Date of Patent: Oct. 29, 2024

(54) OVEN APPLIANCE HAVING A RESTRICTOR PLATE TO PREVENT CONTACT

(71) Applicant: Haier US Appliance Solutions, Inc., Wilmington, DE (US)

(72) Inventors: Alla Hamid Abdelhalim, Chattanooga, TN (US); Venkatapathi Raju Jampana, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 367 days.

(21) Appl. No.: 17/351,362

(22) Filed: Jun. 18, 2021

(65) Prior Publication Data

US 2022/0404028 A1 Dec. 22, 2022

(51) Int. Cl.
*F24C 15/02* (2006.01)
*F24C 15/32* (2006.01)

(52) U.S. Cl.
CPC ..... *F24C 15/02* (2013.01); *F24C 15/32* (2013.01)

(58) Field of Classification Search
CPC ..... F24C 15/027; F24C 15/06; F24C 15/02; F24C 15/32
USPC ..... 126/198, 333
See application file for complete search history.

(56) References Cited

U.S. PATENT DOCUMENTS

| | | | | |
|---|---|---|---|---|
| 4,383,519 A * | 5/1983 | Katona | F24C 15/024 126/190 |
| 5,819,722 A | 10/1998 | Katz | |
| 7,650,881 B2 | 1/2010 | Brown | |
| 2020/0248909 A1 | 8/2020 | Kim | |
| 2022/0205641 A1* | 6/2022 | Su | F24C 15/028 |

FOREIGN PATENT DOCUMENTS

| | | | | |
|---|---|---|---|---|
| CN | 210035605 U * | 2/2020 | A21B 1/245 |
| GB | 1196592 A * | 7/1970 | |
| GB | 2197457 A * | 5/1988 | F24C 15/08 |
| JP | 2021011975 A * | 2/2021 | |
| KR | 101079402 B1 | 11/2011 | |
| WO | WO-2006060751 A2 * | 6/2006 | A21B 1/245 |

* cited by examiner

*Primary Examiner* — Allen R. B. Schult
*Assistant Examiner* — William C Weinert
(74) *Attorney, Agent, or Firm* — Dority & Manning, P.A.

(57) ABSTRACT

An oven appliance may include a cabinet, a door, and a restrictor plate. The cabinet may include a top panel and a bottom panel. The cabinet may define a cooking chamber between the top panel and the bottom panel. The door may be mounted on the cabinet to selectively restrict access to the cooking chamber in a closed position. The door may extend along the vertical direction in the closed position between a top lip and a bottom lip. The restrictor plate may be mounted to the door at the bottom lip. The restrictor plate may extend downward and be spaced apart from the cabinet along the transverse direction.

13 Claims, 9 Drawing Sheets

OVEN APPLIANCE HAVING A RESTRICTOR PLATE TO PREVENT CONTACT

FIELD OF THE INVENTION

The present subject matter relates generally to oven appliances, and more particularly to restrictor plates to prevent contact with at least a portion of an oven appliance.

BACKGROUND OF THE INVENTION

Cooking appliances generally define one or more enclosures supporting one or more heating elements. For instance, oven appliances can include a cabinet defining an insulated cooking chamber therein for receipt of food items for cooking. A cooktop having heating elements may be positioned at a top portion of the cabinet for, as an example, grilling, boiling, or frying food items thereon. Other heating elements, such as a bake heating element or broil heating element may be positioned within the cooking chamber to provide heat to food items located therein. The bake heating element is positioned at a bottom of the cooking chamber. The broil heating element positioned at a top of the cooking chamber. One or more electronic components may be housed within the cabinet outside of the cooking chamber.

In general, it can be desirable to limit a user's ability to contact or engage certain areas of an oven appliance. For instance, it may be useful to block or cover certain portions of a cabinet that might become hot during use. Recently, certain government or trade group standards having even incorporated requirements that accessible portions of an oven cabinet being maintained below one or more temperature thresholds during use. One such requirement is included in the updated UL858 standard (as is intended to take effect in March 2022), which adopts temperature thresholds for the increase in temperature for surfaces below 31 inches in gaps that are accessible by a specified access probe—such surfaces may be required to be measured by an International Electrotechnical Commission (IEC)—compliant temperature probe. For instance, a temperature threshold for bare or painted metal is 33° Celsius, hence the metal may be required to stay at or below is 58° Celsius in a 25° Celsius ambient environment.

In spite of the desirability to limit access or temperature to certain portions of an oven appliance, ensuring this can be difficult or expensive. For instance, simply adding insulating material to portions of the cabinet that are near the surface can significantly add to the cost or size of the oven appliance. Covering other portions of the oven appliance (e.g., near the opening to a cooking chamber) may interfere with necessary airflow, such that might be required to/from the cooking chamber or through the door.

As a result, further improvements to oven appliances are needed. In particular, it may be advantageous to provide an oven appliance including one or more features for restricting access to certain portions of the cooking appliance (e.g., without interfering with operation, increasing the appliance footprint, or significantly raising assembly costs or complexity).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an oven appliance is provided. The oven appliance may include a cabinet, a door, and a restrictor plate. The cabinet may include a top panel and a bottom panel. The cabinet may define a cooking chamber between the top panel and the bottom panel. The door may be mounted on the cabinet to selectively restrict access to the cooking chamber in a closed position. The door may extend along the vertical direction in the closed position between a top lip and a bottom lip. The restrictor plate may be mounted to the door at the bottom lip. The restrictor plate may extend downward and be spaced apart from the cabinet along the transverse direction.

In another exemplary aspect of the present disclosure, an oven appliance is provided. The oven appliance may include a cabinet, a door, and a restrictor plate. The cabinet may include a top panel and a bottom panel. The cabinet may define a cooking chamber between the top panel and the bottom panel. The door may be mounted on the cabinet to selectively restrict access to the cooking chamber in a closed position. The door may extend along the vertical direction in the closed position between a top lip and a bottom lip. The restrictor plate may be mounted to the door at the bottom lip and spaced apart from the cabinet along the transverse direction. The restrictor plate may include a bent mounting rim, a blocking panel, and a bent bottom rim. The bent mounting rim may be disposed against the bottom lip. The blocking panel may extend downward from the bent mounting rim to restrict access to a front panel of the cabinet below the cooking chamber, the bent bottom rim may extend along the transverse direction from the blocking panel below the bent mounting rim.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
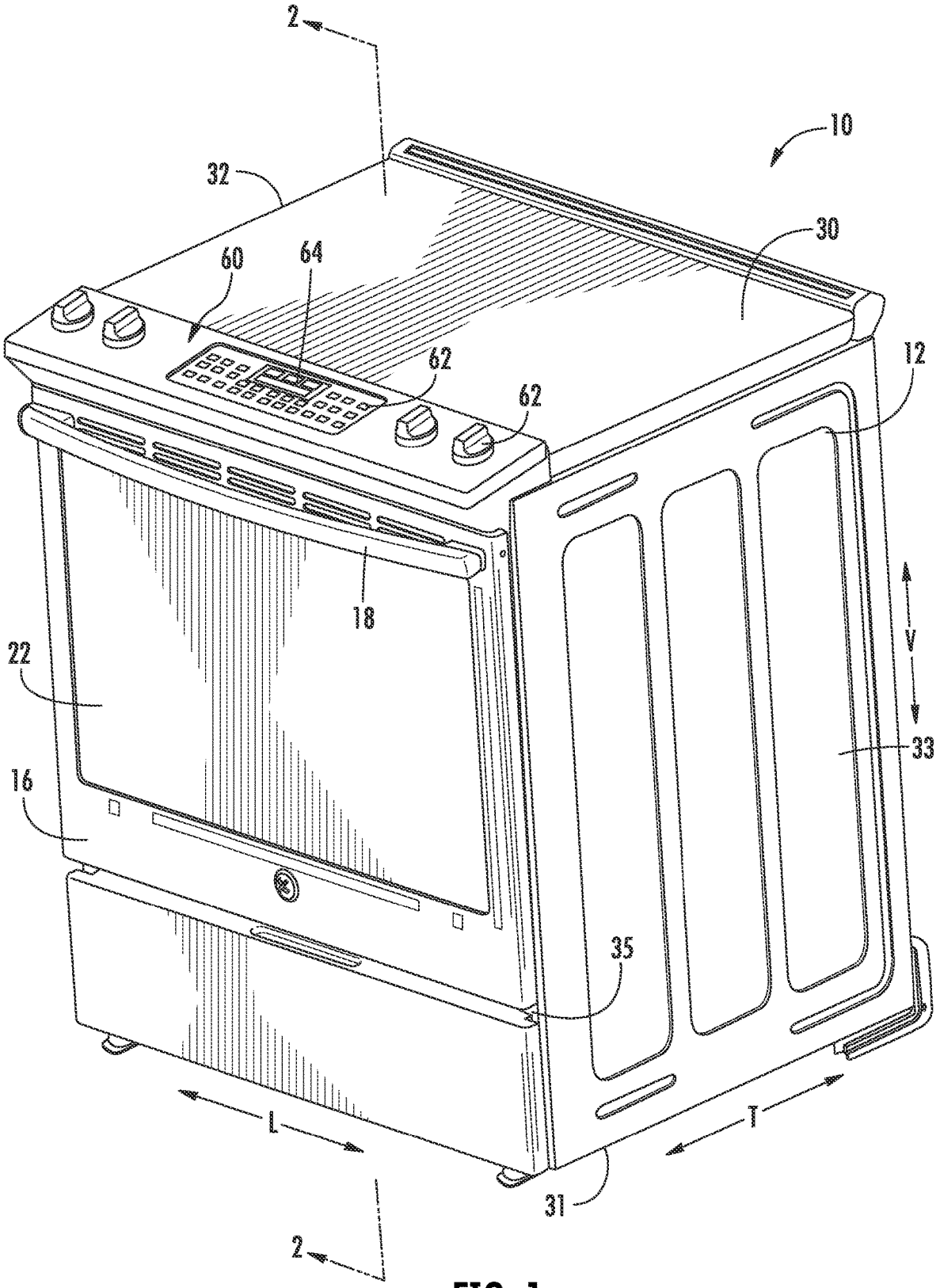
FIG. 1 provides a perspective view of an oven appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. Terms such as "inner" and "outer" refer to relative directions with respect to the interior and exterior of the oven appliance, and in particular the oven chamber(s) defined therein. For example, "inner" or "inward" refers to the direction towards the interior of the oven appliance. Terms such as "left," "right," "front," "back," "top," or "bottom" are used with reference to the perspective of a user accessing the oven appliance (e.g., when the door is in the closed position). For example, a user stands in front of the oven appliance to open a door and reaches into the cooking chamber(s) to access items therein.

Figure 2:
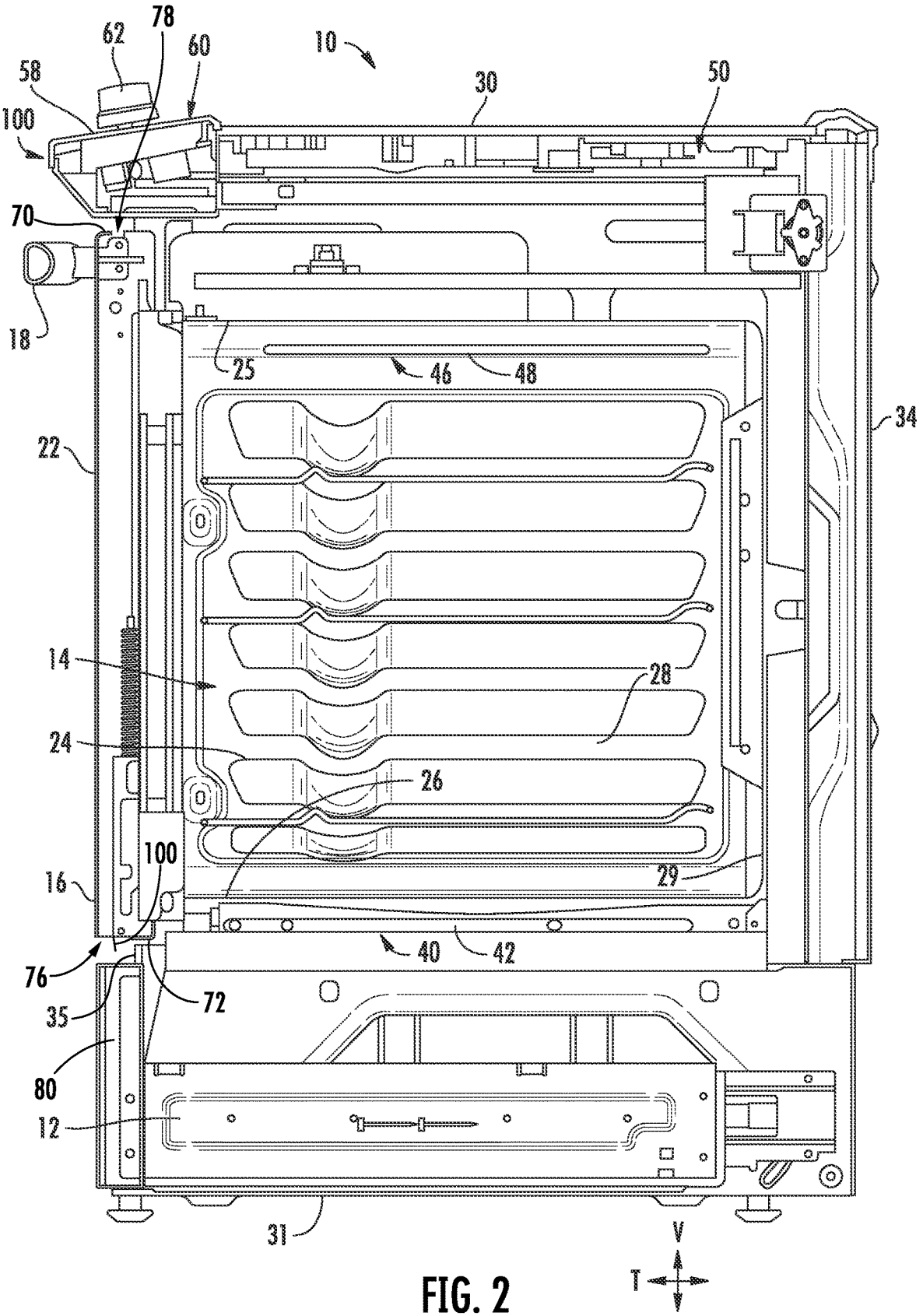
FIG. 2 provides a cross-sectional elevation view of the exemplary oven appliance of FIG. 1 taken along the line 2-2 of FIG. 1.

Turning to the figures, FIGS. 1 and 2 depict an exemplary cooking appliance (e.g., oven appliance 10) that may be configured in accordance with aspects of the present disclosure. FIG. 1 provides a perspective view of an oven appliance 10 according to exemplary embodiments of the present disclosure. FIG. 2 provides a cross sectional elevation view of oven appliance 10 taken along the 2-2 line of FIG. 1. As shown, oven appliance 10 defines a vertical direction V, a lateral direction L, and a transverse direction T. The vertical direction V, lateral direction L, and transverse direction T are mutually perpendicular and form an orthogonal direction system (e.g., generally discussed or referenced to oven appliance 10 having the door 16 in the closed state or position). As will be understood by those skilled in the art, oven appliance 10 is provided by way of example only, and the present subject matter may be used in any suitable cooking appliance. Thus, the present subject matter may be used with other oven appliances having different configurations, such as wall ovens, electric ovens, gas ovens, etc.

Oven appliance 10 includes a cabinet 12 with an insulated cooking chamber 14 disposed within cabinet 12. Insulated cooking chamber 14 is configured for the receipt of one or more food items to be cooked. Oven appliance 10 includes a door 16 rotatably mounted to cabinet 12 (e.g., with a hinge). A handle 18 is mounted to door 16 and assists a user with opening and closing door 16 in order to access insulated cooking chamber 14. For example, a user can pull on handle 18 to open or close door 16 and access insulated cooking chamber 14.

Oven appliance 10 can include a seal (e.g., gasket) between door 16 and cabinet 12 that assists with maintaining heat and cooking fumes within insulated cooking chamber 14 when door 16 is closed as shown. Door 16 may include a window 22, constructed for example from multiple parallel glass panes to provide for viewing the contents of insulated cooking chamber 14 when door 16 is closed and assist with insulating insulated cooking chamber 14. A baking rack may be positioned in insulated cooking chamber 14 for the receipt of food items or utensils containing food items. The baking rack may be slidably received onto embossed ribs 24 or sliding rails such that the baking rack may be conveniently moved into and out of insulated cooking chamber 14 when door 16 is open.

Generally, various sidewalls define insulated cooking chamber 14. For example, insulated cooking chamber 14 includes a top wall 25 and a bottom wall 26 that are spaced apart along the vertical direction V. Left and right sidewalls 28 extend between top wall 25 and bottom wall 26, and are spaced apart along the lateral direction L. A rear wall 29 may additionally extend between the top wall 25 and bottom wall 26 as well as between the left and right sidewalls 28, and is spaced apart from door 16 along the transverse direction T. In this manner, when door 16 is in the closed position, a cooking cavity is defined by door 16 and top wall 25, bottom wall 26, sidewalls 28, rear wall 29, of insulated cooking chamber 14.

As further illustrated, cabinet 12 includes multiple panels that enclose insulated cooking chamber 14. For example, cabinet 12 includes a top panel 30 and a bottom panel 31 that are spaced apart along the vertical direction V. Left panel 32 and right panel 33 (as defined according to the view as shown in FIG. 1) extend between top panel 30 and bottom panel 31, and are spaced apart along the lateral direction L. A rear panel 34 may additionally extend between top panel 30 and bottom panel 31 as well as between left panel 32 and right panel 33, and is spaced apart from door 16 along the transverse direction T. When door 16 is in the closed position, it may sit flush with a front panel or portion 35 of cabinet 12. As shown, front panel 35 extends between top panel 30 and bottom panel 31 to generally define the opening to cooking chamber 14.

In the included figures, panels 30, 31, 32, 33, 34, 35 of cabinet 12 are single ply sheet metal panels, but one skilled in the art will appreciate that any suitably rigid panel may be used while remaining within the scope of the present subject matter. For example, according to exemplary embodiments, panels 30, 31, 32, 33, 34, 35 may be constructed from a suitably rigid and thermally resistant plastic. Additionally or alternatively, each panel 30, 31, 32, 33, 34, 35 may include multiple layers made from the same or different materials, and may be formed in any suitable shape.

A lower heating assembly (e.g., bake heating assembly 40) may be positioned in oven appliance 10, and may include one or more heating elements (e.g., bake heating elements 42). Bake heating elements 42 may be disposed within insulated cooking chamber 14, such as adjacent bottom wall 26. In exemplary embodiments as illustrated, the bake heating elements 42 are electric heating elements, as is generally understood. Alternatively, the bake heating elements 42 may be gas burners or other suitable heating elements having other suitable heating sources. Bake heating elements 42 may generally be used to heat insulated cooking chamber 14 for both cooking and cleaning of oven appliance 10.

Additionally or alternatively, an upper heating assembly (e.g., broil heating assembly 46) may be positioned in oven appliance 10, and may include one or more upper heating elements (e.g., broil heating elements 48). Broil heating elements 48 may be disposed within insulated cooking chamber 14, such as adjacent top wall 25. In exemplary embodiments as illustrated, the broil heating elements 48 are electric heating elements, as is generally understood. Alternatively, the broil heating elements 48 may be gas burners or other suitable heating elements having other suitable heating sources. Broil heating elements 48 may additionally be used to heat insulated cooking chamber 14 for both cooking and cleaning of oven appliance 10.

Figure 3:
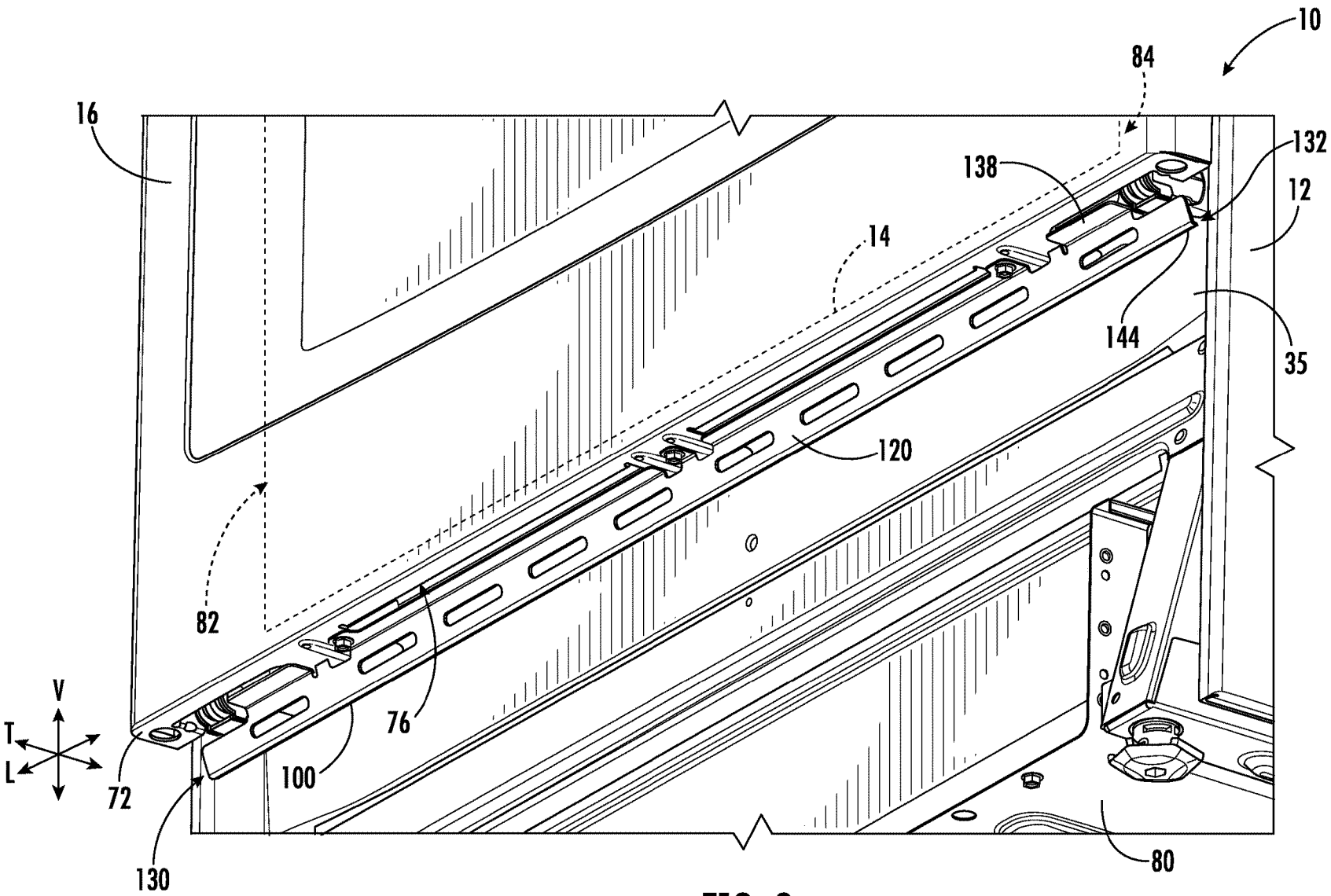
FIG. 3 provides a perspective view of a bottom portion of an oven appliance according to exemplary embodiments of the present disclosure.
Figure 4:
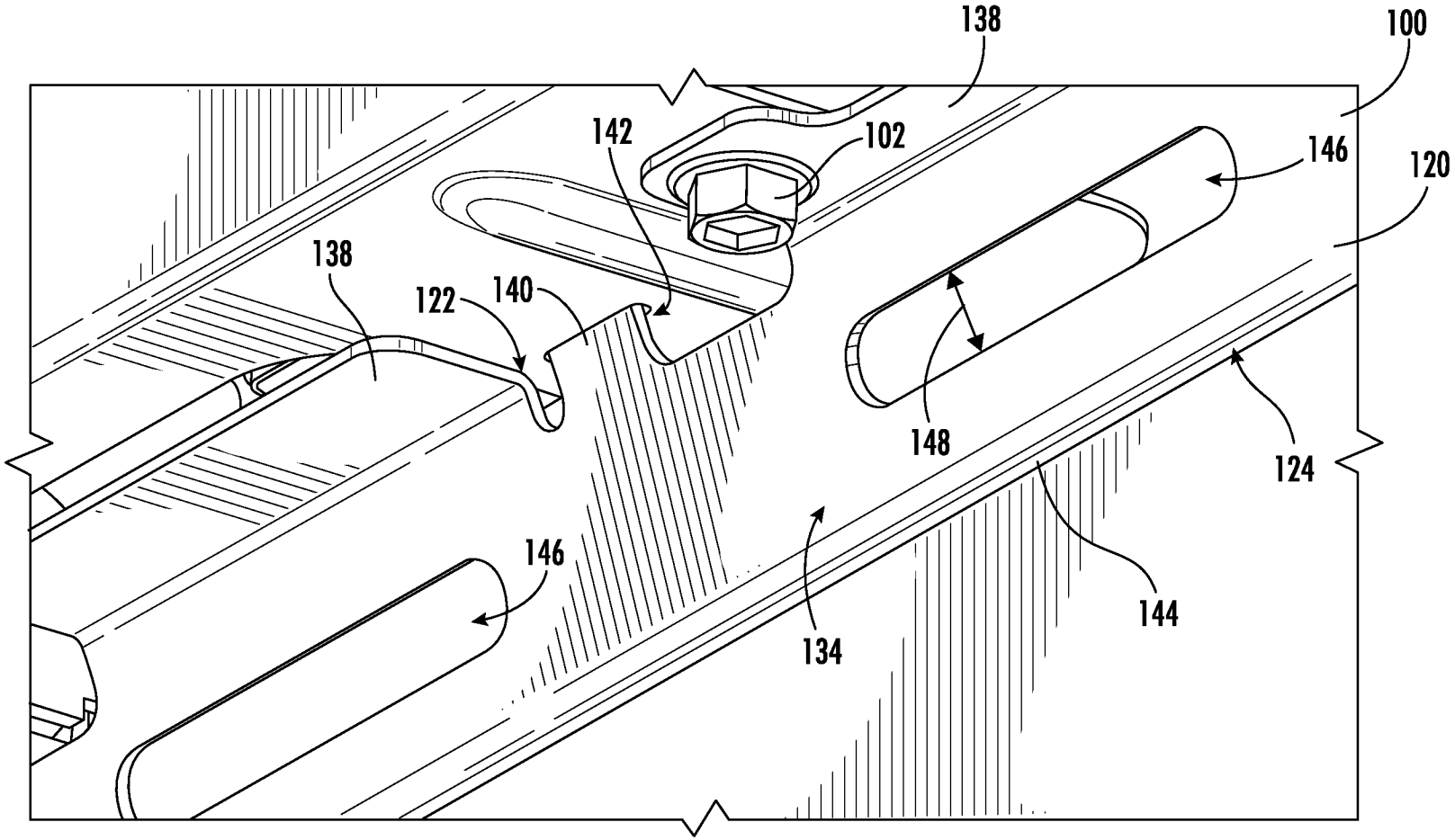
FIG. 4 provides a magnified perspective view of the exemplary oven appliance of FIG. 3.
Figure 5:
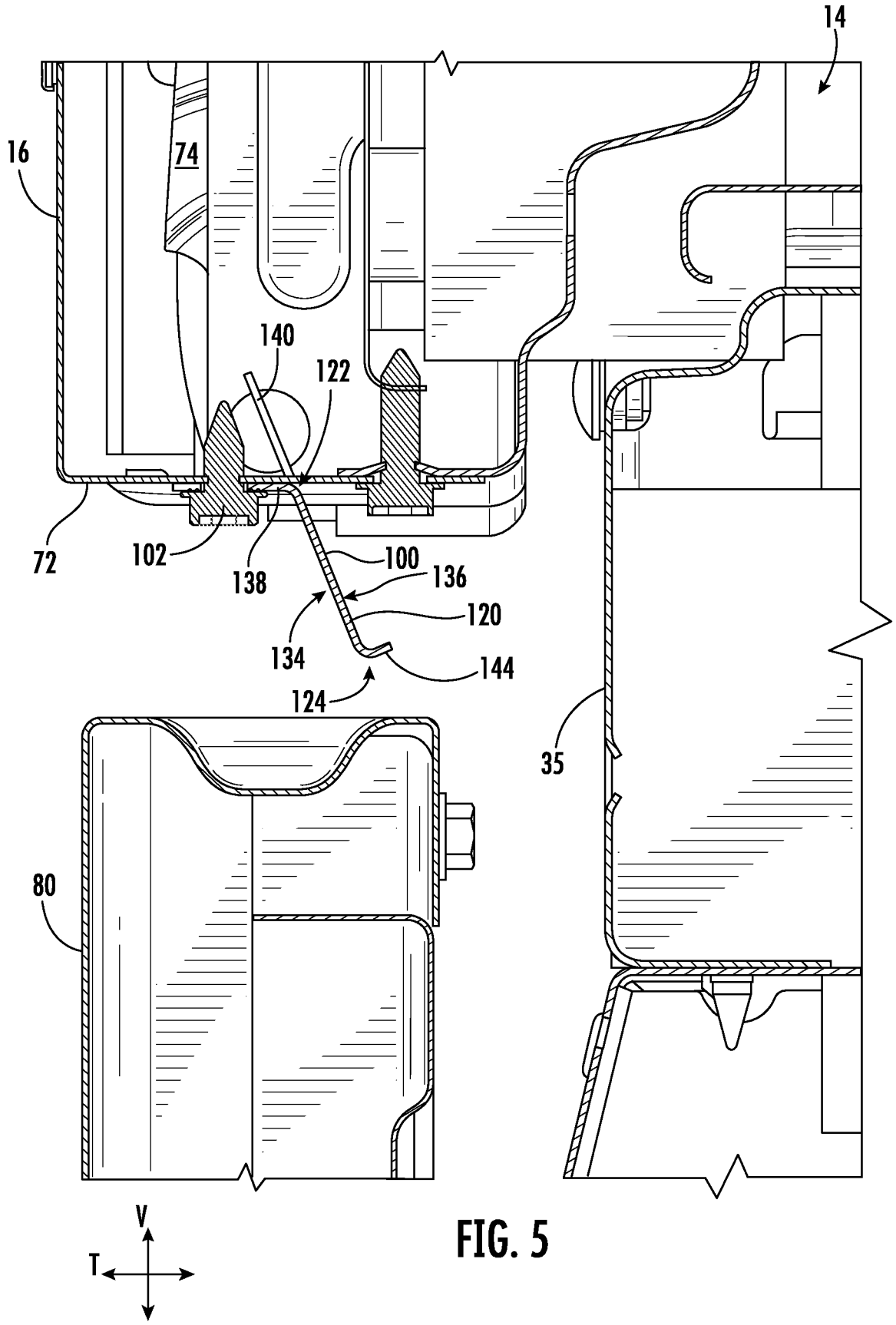
FIG. 5 provides a cross-sectional elevation view a bottom portion of the exemplary oven appliance of FIG. 3.
Figure 6:
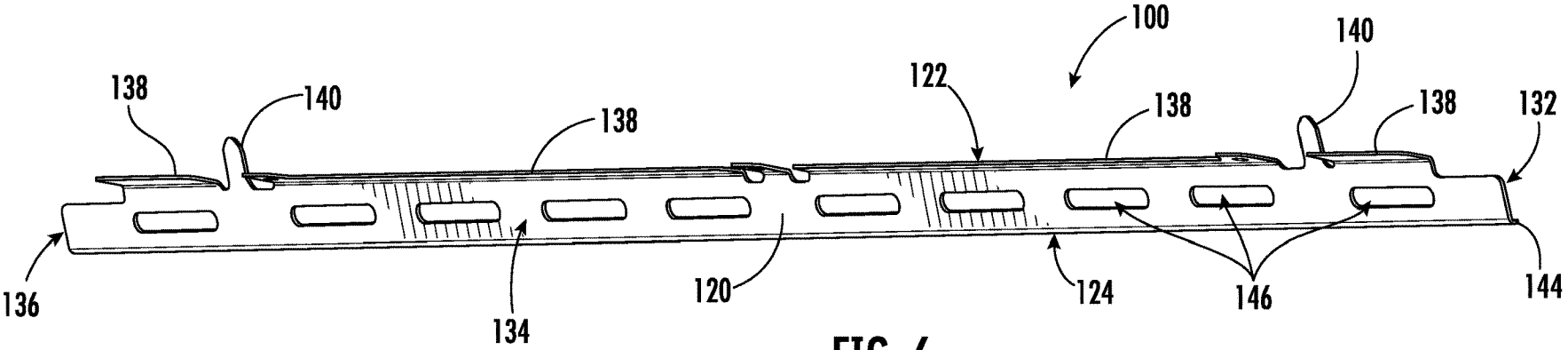
FIG. 6 provides a perspective view of the restrictor plate, in isolation, of the exemplary oven appliance of FIG. 3.

In some embodiments, oven appliance 10 includes a cooktop positioned at top panel 30 of oven appliance 10. In such embodiments, top panel 30 may be a generally planar member having an upper surface that is perpendicular to the vertical direction V. In particular, top panel 30 may be formed from glass, glass ceramic, metal, or another suitable material. A plurality of heating assemblies (e.g., cooktop heating assemblies 50) may be mounted to or otherwise positioned on top panel 30. In some embodiments, heating assemblies 50 are positioned above insulated cooking chamber 14 of cabinet 12 (i.e., higher relative to the vertical direction V). Optionally, heating assemblies 50 may extend between cooking chamber 14 and top panel 30, within an open region that is defined between top panel 30 and the insulated cooking chamber 14. Cooking utensils, such as pots, pans, griddles, etc., may be placed on top panel 30 and heated with heating assemblies 50 during operation of the cooktop. In FIGS. 1 through 3, heating assemblies 50 are shown as radiant heating elements mounted below top panel 30. However, in alternative example embodiments, heating assemblies 50 may be any suitable heating assembly, such as gas burner elements, resistive heating elements, induction heating elements, etc.

In some embodiments, oven range appliance 10 also includes features for limiting or reducing heat transfer within door 16 (e.g., along the transverse direction T during operation of oven range appliance 10). As may be seen in FIG. 2, door 16 extends between a top lip 70 and a bottom lip 72 (e.g., along the vertical direction V when door 16 is in the closed position). As will be described in greater detail below, a restrictor plate 100 may be mounted to door 16 (e.g., at bottom lip 72) to move therewith and generally block or restrict access to at least a portion of cabinet 12.

In some embodiments, door 16 defines an intake 76, a conduit or channel 74, and an exhaust 78. In some embodiments, intake 76 of door 16 is positioned at or adjacent bottom lip 72 of door 16 and permits air therethrough. Conversely, exhaust 78 of door 16 is positioned at or adjacent top lip 70 of door 16. Channel 74 extends between intake 76 of door 16 and exhaust 78 of door 16 (e.g., such that intake 76 and exhaust 78 are in fluid communication with each other when door 16 is in the closed position). Channel 74 permits the flow of air to flow through door 16 from intake 76 to exhaust 78. Exhaust 78 may be located at top surface of the door 16, a front surface of door 16, or a combination thereof.

The flow of air through door 16 can assist with limiting or reducing heat transfer along the transverse direction T (e.g., during operation of bottom or top heating elements 42 and 48 of oven range appliance 10). As an example, an inner surface of door 16 faces and is positioned adjacent cooking chamber 14 of cabinet 12 when door 16 is in the closed position. Conversely, an outer surface of door 16 is positioned opposite inner surface of door 16 and faces away from cooking chamber 14 of cabinet 12 when door 16 is in the closed position. The flow of air can be cool relative to the inner surface of door 16 such that the flow of air limits or reduces heat transfer between the inner surface of door 16 and the outer surface of door 16 during operation of bottom or top heating elements 48 and 42 of oven range appliance 10 (e.g., such that the outer surface of door 16 is cool relative to the inner surface of door 16). In such a manner, the outer surface of door 16 can be insulated.

In some embodiments, oven appliance 10 includes a drawer 80 movably mounted to cabinet 12. For instance, drawer 80 may be slidably mounted to cabinet 12 to selectively move forward/rearward along the transverse direction T. One or more slidable rails, bearings, or assemblies may be installed or mounted between drawer 80 and cabinet 12 to facilitate movement of drawer 80 relative to cabinet 12, as would be understood. As shown, drawer 80 may be disposed generally below cooking chamber 14. In particular, drawer 80 may be disposed below door 16 and restrictor plate 100 (e.g., such that neither door 16 nor restrictor plate 100 is in contact with drawer 80). Generally, drawer 80 is disposed between left panel 32 and right panel 33 (e.g., along the lateral direction L) Optionally, drawer 80 may be disposed above bottom panel 31. Alternatively, drawer 80 may be disposed below bottom panel 31 (e.g., such that an open cavity or recess is defined between panels 32, 33 below bottom panel 31 to receive drawer 80).

Oven appliance 10 is further equipped with a controller 58 to regulate operation of the oven appliance 10. For example, controller 58 may regulate the operation of oven appliance 10, including activation of heating elements 42, 48, 50, as well as heating assemblies 40, 46 generally. Controller 58 may be in operable communication (e.g., via a suitable electronic wired connection) with the heating elements 42, 48, 50 and other components of the oven appliance 10, as discussed herein. In general, controller 58 may be operable to configure the oven appliance 10 (and various components thereof) for cooking. Such configuration may be based on a plurality of cooking factors of a selected operating cycles, sensor feedback, etc.

By way of example, controller 58 may include one or more memory devices (e.g., non-transitive media) and one or more microprocessors, such as general or special purpose microprocessors operable to execute programming instructions or micro-control code associated with an operating cycle. The memory may represent random access memory such as DRAM, or read only memory such as ROM or FLASH. In exemplary embodiments, the processor executes programming instructions stored in memory. The memory may be a separate component from the processor or may be included onboard within the processor.

Controller 58 may be positioned in a variety of locations throughout oven appliance 10. For instance, controller 58 may be located within a user interface panel 60 of oven appliance 10, as shown in FIG. 2. In some such embodiments, input/output ("I/O") signals may be routed between the control system and various operational components of oven appliance 10 along wiring harnesses that may be routed through cabinet 12. In some embodiments, controller 58 is in operable communication (e.g., electronic or wireless communication) with user interface panel 60 and controls 62, through which a user may select various operational features and modes and monitor progress of oven appliance 10. In optional embodiments, user interface panel 60 may represent a general purpose I/O ("GPIO") device or functional block. In certain embodiments, user interface panel 60 includes input components or controls 62, such as one or more of a variety of electrical, mechanical or electromechanical input devices including rotary dials, push buttons, and touch pads. Additionally or alternatively, user interface panel 60 may include a display component, such as a digital or analog display device 64 designed to provide operational feedback to a user. User interface panel 60 may be in operable communication with controller 58 via one or more signal lines or shared communication busses.

It should be appreciated that the invention is not limited to any particular style, model, or configuration of oven appliance 10. The exemplary embodiments depicted in the figures are for illustrative purposes only. For example, different locations may be provided for user interface panel 60, different configurations may be provided for the baking rack or ribs 24, different cooling air flow paths may be utilized, and other differences may be applied as well.

Turning now generally to FIGS. 2 through 10, various embodiments including restrictor plate 100 will generally be described. As described above, restrictor plate 100 may be mounted to a bottom portion of door 16. In particular, restrictor plate 100 may be mounted to bottom lip 72. For instance, one or more mechanical fasteners 102 (e.g., screws, bolts, clips, etc.) may hold restrictor plate 100 on door 16 to rotate therewith. Restrictor plate 100 itself may be formed from any suitable, heat resistant material or metal (e.g., steel, stainless steel, or aluminum, including alloys thereof).

Generally, restrictor plate 100 includes a blocking panel 120 that extends downward from door 16 (e.g., parallel or at a non-orthogonal angle relative to vertical direction V) from a top end 122 to a bottom end 124. Blocking panel 120 further extends along the lateral direction L from a first plate side 130 to a second plate side 132. When assembled a front facing surface 134 is directed outward (e.g., in the transverse direction T), away from front panel 35 while a rear facing surface 136 opposite of front facing surface 134 is directed inward (e.g., in the transverse direction T), toward front panel 35.

In some embodiments, restrictor plate 100 includes a bent mounting rim 138 formed at top end 122. As shown, bent mounting rim 138 may extend (e.g., directly) from blocking panel 120. For instance, bent mounting rim 138 may extend horizontally along the transverse direction T (e.g., forward or rearward). In some such embodiments, at least a portion of restrictor plate 100 is formed from a stamped metal having a top portion of stamped metal being bent to form bent mounting rim 138. When assembled, bent mounting rim 138 may be disposed on door 16 (e.g., against bottom lip 72). In turn, bent mounting rim 138 may be in contact with bottom lip 72. The one or more mechanical fasteners 102 holding restrictor plate 100 to door 16 may be secured to or extend through bent mounting rim 138.

Separate from or in addition to bent mounting rim 138, one or more assembly aid tabs 140 may be provide at top end 122. For instance, turning especially to FIGS. 4 through 6, 9, and 10, one or more assembly aid tabs 140 may extend generally upward from blocking panel 120. Optionally, multiple assembly aid tabs 140 may be provided at discrete portions of restrictor plate 100 between first plate side 130 and second plate side 132. In other words, multiple assembly aid tabs 140 may be spaced apart from each other along the lateral direction. When assembled, the assembly aid tabs 140 may be received within door 16. For instance, each assembly aid tab 140 may be received within a corresponding aperture 142 defined through bottom lip 72. In some such embodiments, the assembly aid tabs 140 may be held within (i.e., extend within) internal channel 74. Advantageously, assembly aid tabs 140 may ensure easy installation and alignment of restrictor plate 100 relative to door 16 and cabinet 12.

Returning generally to FIGS. 3 through 9, in additional or alternative embodiments, restrictor plate 100 includes a bent bottom rim 144 formed at bottom end 124. As shown, bent bottom rim 144 may extend horizontally along the transverse direction T (e.g., rearward). Although bent bottom rim 144 extends rearward, bent bottom rim 144 may end or terminate before reaching front panel 35 and may be prevented from directly touching or engaging cabinet 12, generally. In some embodiments, restrictor plate 100 may be formed from a stamped metal having a bottom portion of stamped metal being bent to form bent bottom rim 144. Optionally, bent bottom rim 144 may extend along all or substantially all (e.g., more than 75%) of the lateral length from first plate side 130 to second plate side 132. Advantageously, bent bottom rim 144 may block or prevent an access probe from reaching to front panel 35 or cooking chamber 14 (e.g., from a gap between door 16 and front panel 35 when an access probe is inserted at a non-horizontal angle toward cabinet 12).

Turning especially to FIGS. 3 through 6, 9, and 10, certain embodiments of restrictor plate 100 define one or more transverse holes 146. As shown, each transverse hole 146 may extend through, for example, blocking panel 120 along the transverse direction T. Specifically, each transverse hole 146 may extend all the way through restrictor plate 100 from front facing surface 134 to rear facing surface 136. Thus, air may be permitted to pass through the transverse holes 146. In embodiments wherein multiple transverse holes 146 are defined, one or more of the transverse holes 146 may be spaced apart from each other along the lateral direction L. Generally, each transverse hole 146 may be formed as any suitable shape. For instance, each transverse hole 146 may be formed according to a circular or elliptical profile through blocking panel 120. Optionally, each transverse hole 146 may define a minimum diameter or width 148 that is less than or equal to 8.6 millimeters. Additionally or alternatively, the minimum diameter or width 148 may be greater than or equal to one millimeter. Advantageously, air may be permitted through each transverse hole 146 while a UL-compliant access probe is not.

Figure 7:
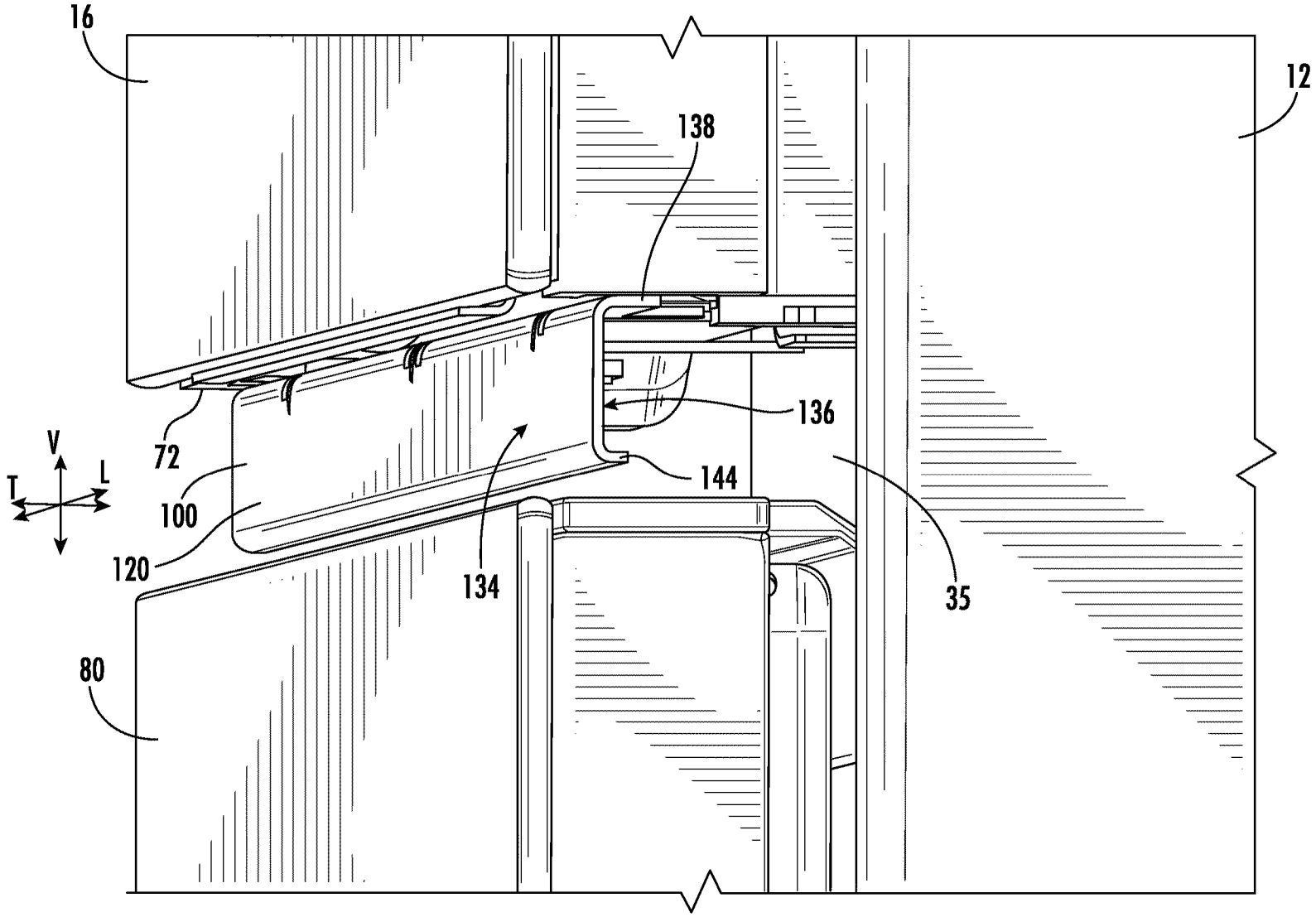
FIG. 7 provides a perspective view of a bottom portion of an oven appliance according to exemplary embodiments of the present disclosure.
Figure 8:
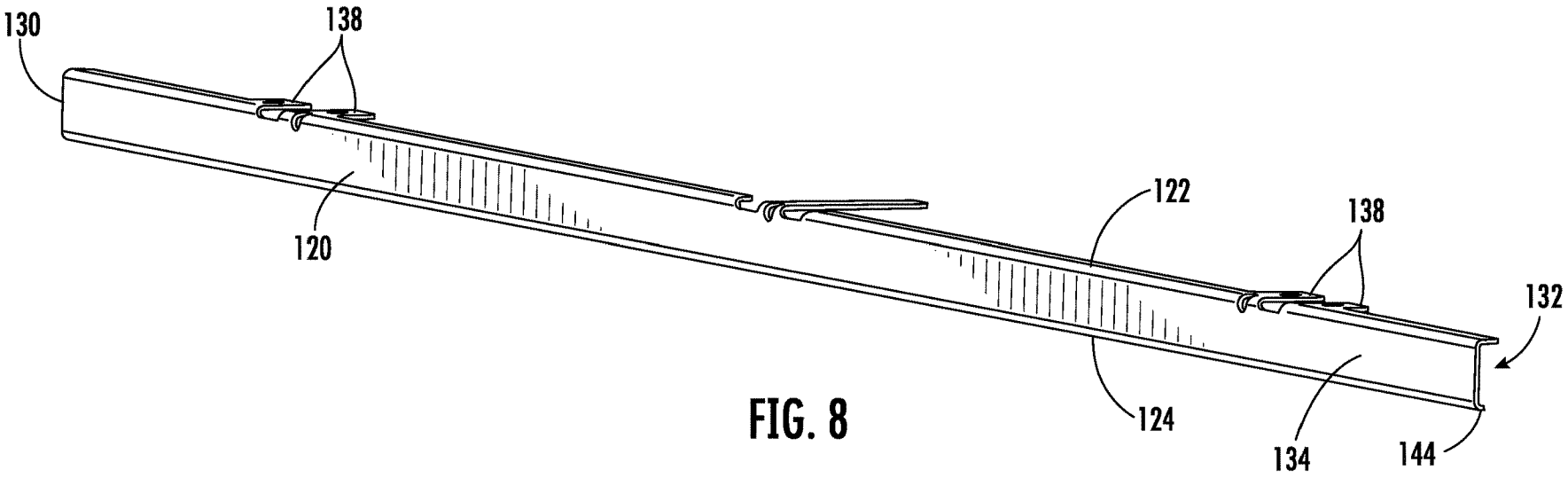
FIG. 8 provides a perspective view of the restrictor plate, in isolation, of the exemplary oven appliance of FIG. 7.
Figure 9:
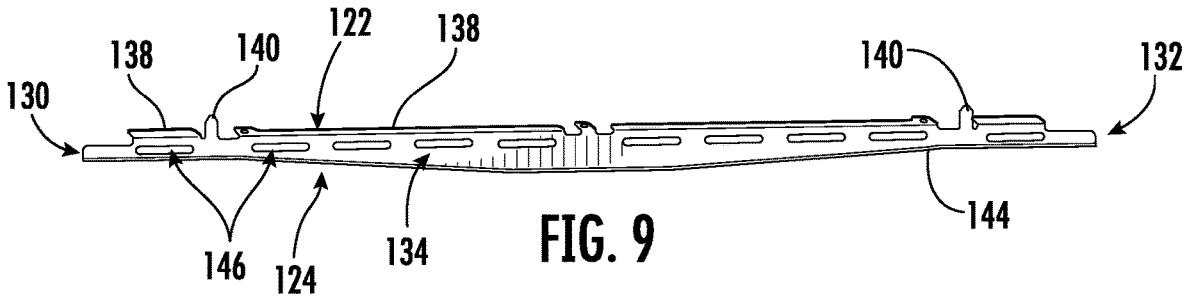
FIG. 9 provides a perspective view of a restrictor plate, in isolation, of an oven appliance according to exemplary embodiments of the present disclosure.
Figure 10:
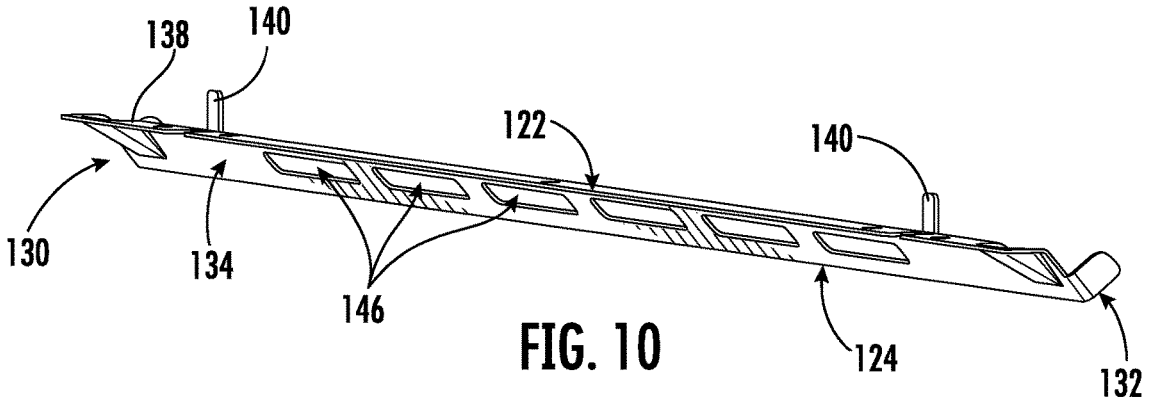
FIG. 10 provides a perspective view of a restrictor plate, in isolation, of an oven appliance according to exemplary embodiments of the present disclosure.

Turning briefly to FIGS. 7 and 8, although certain embodiments of restrictor plate 100 may define multiple transverse holes 146, as discussed above, alternative embodiments may include a solid, non-permeable blocking panel 120 free of any transverse holes 146 to permit the passage of air therethrough.

Returning especially to FIGS. 2 through 5 and 7, the assembled oven appliance may include restrictor plate 100 mounted to door 16, as described above. Although restrictor plate 100 is mounted to door 16, though, restrictor plate 100 may also be spaced apart from cabinet 12. For instance, restrictor plate 100 may be at least spaced apart from front panel 35 along the transverse direction T. Thus, restrictor plate 100 may be prevented from contacting cabinet 12 (e.g., even when door 16 is moved to an open position or otherwise away from the closed position).

Along with being spaced apart from cabinet 12, restrictor plate 100 may be spaced apart from drawer 80. Specifically, restrictor plate 100 may be held above drawer 80 along the vertical direction. A vertical gap may be defined between an uppermost edge of drawer 80 and the bottom end 124 or bent bottom lip 72 of restrictor plate 100.

In some embodiments, restrictor plate 100 spans the lateral distance or length of the opening to cooking chamber 14. As an example, cooking chamber 14 may extend along a lateral length in the lateral direction L between a first chamber side 82 (e.g., at left panel 32) and a second chamber side 84 (e.g., at right panel 34). In turn, restrictor plate 100 may extend along its own lateral length to span past the lateral length of cooking chamber 14. Thus, the first plate side 130 may be disposed outward from the first chamber side 82 (e.g., to the left thereof) and the second plate side 132 may be disposed outward from the second chamber side 84 (e.g., to the right thereof). Attempts to access any gap between door 16 and opening from an area beneath door 16 may thus be blocked by restrictor plate 100.

Advantageously, the above-described embodiments of restrictor plate 100 may prevent access to otherwise elevated-temperature surfaces without interfering with operation, increasing the appliance footprint, or significantly raising assembly costs or complexity of appliance 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance defining a vertical direction, a lateral direction, and a transverse direction, the cooking appliance comprising:

a cabinet comprising a top panel and a bottom panel, the cabinet defining a cooking chamber between the top panel and the bottom panel;

a door mounted on the cabinet to selectively restrict access to the cooking chamber in a closed position, the door extending along the vertical direction in the closed position between a top lip and a bottom lip, the door defining an internal channel defining a bottom intake; and a restrictor plate mounted to the door at the bottom lip, the restrictor plate comprising a bent mounting rim disposed against the bottom lip, a blocking panel extending downward from the bent mounting rim to restrict access to a front panel of the cabinet below the cooking chamber, and a bent bottom rim extending along the transverse direction from the blocking panel below the bent mounting rim, wherein the cooking chamber extends along a lateral length in the lateral direction between a first chamber side and a second chamber side, wherein the restrictor plate spans past the lateral length along the lateral direction between the first chamber side and the second chamber side, wherein the door defines an internal channel to permit air therethrough, wherein the restrictor plate comprises an assembly aid tab extending into the internal channel, and wherein the restrictor plate is disposed rearward from the bottom intake.

2. The cooking appliance of claim 1, wherein the bent bottom rim extends rearward from a bottom portion of the blocking panel.

3. The cooking appliance of claim 2, wherein the bent mounting rim is disposed against the bottom lip.

4. The cooking appliance of claim 1, wherein the restrictor plate defines a transverse hole extending therethrough from a front facing surface of the restrictor plate to a rear facing surface of the restrictor plate.

5. The cooking appliance of claim 1, wherein the restrictor plate defines a plurality of transverse holes extending therethrough and spaced apart along the lateral direction.

6. The cooking appliance of claim 1, wherein the cooking appliance further comprises a drawer slidably mounted to the cabinet below the door and the restrictor plate.

7. A cooking appliance defining a vertical direction, a lateral direction, and a transverse direction, the cooking appliance comprising:

a cabinet comprising a top panel and a bottom panel, the cabinet defining a cooking chamber between the top panel and the bottom panel;

a door mounted on the cabinet to selectively restrict access to the cooking chamber in a closed position, the door extending along the vertical direction in the closed position between a top lip and a bottom lip, the door defining an internal chamber; and restrictor plate mounted directly to the door at the bottom lip to pivot therewith and spaced apart from the cabinet along the transverse direction such that the restrictor plate is prevented from contacting the cabinet, the restrictor plate comprising a bent mounting rim disposed against the bottom lip, a blocking panel extending downward from the bent mounting rim to restrict access to a front panel of the cabinet below the cooking chamber, and a bent bottom rim extending along the transverse direction from the blocking panel below the bent mounting rim, wherein the cooking chamber extends along a lateral length in the lateral direction between a first chamber side and a second chamber side, wherein the restrictor plate spans past the lateral length along the lateral direction between the first chamber side and the second chamber side, wherein the door defines an internal channel to permit air therethrough, wherein the restrictor plate comprises an assembly aid tab extending into the internal channel, and wherein the restrictor plate is disposed rearward from a bottom intake.

8. The cooking appliance of claim 7, wherein the bent bottom rim extends rearward from a bottom portion of the blocking panel.

9. The cooking appliance of claim 7, wherein the restrictor plate defines a transverse hole extending therethrough from a front facing surface of the restrictor plate to a rear facing surface of the restrictor plate.

10. The cooking appliance of claim 7, wherein the restrictor plate defines a plurality of transverse holes extending therethrough and spaced apart along the lateral direction.

11. The cooking appliance of claim 7, wherein the cooking appliance further comprises a drawer slidably mounted to the cabinet below the door and the restrictor plate.

12. A cooking appliance defining a vertical direction, a lateral direction, and a transverse direction, the cooking appliance comprising:

a cabinet comprising a top panel and a bottom panel, the cabinet defining a cooking chamber between the top panel and the bottom panel;

a door mounted on the cabinet to selectively restrict access to the cooking chamber in a closed position, the door extending along the vertical direction in the closed position between a top lip and a bottom lip, the door defining an internal channel extending from a bottom intake to a top exhaust to permit an airflow through the door; and a restrictor plate mounted to the door at the bottom lip and spaced apart from the cabinet along the transverse direction such that the restrictor plate is prevented from contacting the cabinet, the restrictor plate comprising a bent mounting rim disposed against the bottom lip, a blocking panel extending downward from the bent mounting rim to restrict access to a front panel of the cabinet below the cooking chamber, and a bent bottom rim extending along the transverse direction from the blocking panel below the bent mounting rim, wherein the cooking chamber extends along a lateral length in the lateral direction between a first chamber side and a second chamber side, wherein the restrictor plate spans past the lateral length along the lateral direction between the first chamber side and the second chamber side, wherein the door defines an internal channel to permit air therethrough, wherein the restrictor plate comprises an assembly aid tab extending into the internal channel, and wherein the restrictor plate is disposed rearward from the bottom intake.

13. The cooking appliance of claim 12, wherein the restrictor plate defines a plurality of transverse holes extending therethrough and spaced apart along the lateral direction.

* * * * *